United States Patent [19]

Zolotar et al.

[11] Patent Number: 4,854,820

[45] Date of Patent: Aug. 8, 1989

[54] CENTRIFUGAL PUMP FOR HANDLING LIQUIDS CARRYING SOLID ABRASIVE PARATICLES

[76] Inventors: Arkady I. Zolotar, Stremyanny pereulok, 33, kv. 11; David S. Samoilovich, Sakhalinskaya ulitsa, 4, kv. 179; Vladimir K. Karakhanian, 9 Parkovaya ulitsa, 6, korpus 1, kv. 80; Vyacheslav I. Kuznetsov, ulitsa Uchinskaya, 3, kv. 28; Vladimir B. Kopelyansky, Kashirskoe shosse, 7, korpus 1, kv. 139; Oleg V. Kuznetsov, B. Cheremushkinskaya ulitsa, 10, korpus 2, kv. 70, all of Moscow; Vladimir E. Nesterenko, Bobruisk, Internatsionalnaya ulitsa, 41, kv. 45, Mogilevskaya; Nikolai G. Karachaban, Moskovskaya ulitsa, 8, kv. 11; Georgy E. Shmuratov, Komsomolskaya ulitsa, 23, kv. 114, both of Mirny; Evgeny A. Kljuzhin, Berezovaya Alleya, 5, kv. 141, Moscow; Semen V. Livshits, Oktyabrskaya ulitsa, 151, kv. 22, Bobruisk, all of U.S.S.R.

[21] Appl. No.: 138,598

[22] Filed: Dec. 28, 1987

[30] Foreign Application Priority Data

Feb. 18, 1987 [SU] U.S.S.R. ..... 4194517

[51] Int. Cl.[4] ..... F04D 29/08

[52] U.S. Cl. ..... 415/171.1; 415/87; 416/186 R

[58] Field of Search ..... 415/97.98, 168, 169 R, 415/169 A, 170 B, 86, 87, 172 R; 416/183, 184, 185, 186 R

[56] References Cited

U.S. PATENT DOCUMENTS

| | | | |
|---|---|---|---|
| 3,146,722 | 9/1964 | Warman | 415/214 |
| 3,190,226 | 6/1965 | Judd | 416/185 |
| 3,535,051 | 10/1970 | Turner | 415/169 A |
| 3,759,628 | 9/1973 | Kempf | 415/219 C |
| 4,475,868 | 10/1984 | Renger | 415/206 |
| 4,527,947 | 7/1985 | Elliott | 415/213 A |
| 4,556,239 | 12/1985 | Eriksson | 415/170 A |
| 4,664,592 | 5/1987 | Grzina 415 | 170 B/ |

FOREIGN PATENT DOCUMENTS

| | | | |
|---|---|---|---|
| 503046 | 4/1976 | U.S.S.R. | 416/185 |
| 769095 | 10/1980 | U.S.S.R. . | |

*Primary Examiner*—Robert E. Garrett
*Assistant Examiner*—John T. Kwon
*Attorney, Agent, or Firm*—Ladas & Parry

[57] ABSTRACT

A centrifugal pump is proposed for handling liquids carrying solid abrasive particles in a casing having a flow-through portion formed by a discharge passage and a flow-through passage of an impeller accommodated inside the casing. The discharge passage is confined by a front and rear wall of the casing, relative to the incoming flow of the liquid being transferred, and by a peripheral wall of the casing integral with the front and rear walls. The geometry of the peripheral wall of the casing follows the pattern of the distribution of the solid abrasive particles in the flow-through portion of the pump. The flow-through passage is formed by a carrying disk mounted on a drive shaft and having vanes secured thereto, and by a driven disk secured on the vanes.

6 Claims, 6 Drawing Sheets

CENTRIFUGAL PUMP FOR HANDLING LIQUIDS CARRYING SOLID ABRASIVE PARATICLES

FIELD OF THE INVENTION

This invention relates to the art of pump construction, and more particularly to a centrifugal pump for handling liquids carrying solid abrasive particles.

The invention can be used with success in the mining and ore beneficiation industries, as well as in heat power electric plants for pumping slag.

BACKGROUND OF THE INVENTION

High demand for raw materials and ever increasing production volumes associated with processing raw materials, as well as involvement into industrial production of raw materials having low concentration of the useful ingredients and high percentage of abrasive inclusions require that the flow-through portions of centrifugal pumps susceptible to abrasive wear should have a longer service life. Centrifugal forces cause separation of solid abrasive particles in the flow-through passage of the impeller resulting in fast non-uniform wear of inner surface of the carrying disk, vanes, and peripheral wall of the discharge passage.

Leading companies in the field of pump construction, such as "Warman", "Worthington", "Humboldt" and others attempt to increase the service life of centrifugal pumps by using new wear-resistant materials and by improving the technology involved in fabrication of elements of the flow-through portion. However, developments along these lines are extensive, and therefore an increase in the pump service life never exceeds 30–50%.

In the Soviet Union the problem of extending the service life of centrifugal pumps for handling liquids containing solid abrasive inclusions is solved both by making use of new wear resistant materials and improving procedures and techniques associated with fabrication of elements of the pump flow-through portion, and by designing new variations in the geometry of the flow-through passages. For example, there is known an impeller of a centrifugal pump for handling liquids carrying solid abrasive inclusions (cf., SU, A, No. 769,095). A centrifugal pump provided with this known impeller and tried by the "Serlachius" company has shown an impeller service life three times the service life of the pump impeller fabricated by this company.

When pumping a kimberlit pulp the impeller according to SU, A, No. 769,095 served 2–2.5 times longer than the mass-produced impellers of conventional geometry; whereas during pumping an iron ore pulp the increase in the impeller service life amounted to a factor of 3.5.

Also worth mentioning are improvements of the "Warman" company with respect to variations in the conventional geometry of the flow-through portion of the impeller and discharge passage.

There is further known a centrifugal pump for handling liquids containing solid abrasive inclusions (cf. AU, A, No. 2,528,16).

In this known centrifugal pump construction the flow-through portion is defined by a discharge passage and a flow-through passages of the impeller disposed in the housing of the pump. The impeller has a carrying disk mounted in a cantilever fashion on a drive shaft with vanes attached by their side edges to the carrying disk, other side edges of the vanes being secured to a driven disk. The discharge passage is confined by two side walls, front and rear relative to the incoming flow, and by a peripheral wall made integral with the front and rear walls. The peripheral wall has in the meridional section of the housing of the pump casing two curvilinear portions each connected with a rectilinear portion located in the middle of the peripheral wall of the discharge passage. The curvilinear portions are pocket projections, and are integrated with the front and rear walls of the discharge passage, respectively. The carrying and driven disks of the impeller are crimped accordingly toward the rear and front walls of the discharge passage. A discharge vane edge of each vane of the impeller is curvilinear, having a concavity facing the rectilinear portion of the peripheral wall of the discharge passage.

The heretofore described construction of the pump provides such a flow of liquid containing abrasive inclusions which results in reduced hydraulic losses during the travel of the liquid in the discharge passage and consequently in more efficient operation of the pump.

However, such an arrangement of the flow-through portion of the pump limits the range of application to highly dispersed abrasive mixtures. When this known pump is used for handling liquids containing solid abrasive inclusions sizing over 2 mm, the discharge passage is liable to failure due to fast wear of its peripheral wall. When pumping liquids containing large-size abrasive inclusions, the latter tend to penetrate the pocket in the zone of the rear wall of the discharge passage to accumulate therein and cause local damage to the surface of the casing of the discharge passage due to vigorous contact therewith.

SUMMARY OF THE INVENTION

It is an object of the present invention to increase the service life of a centrifugal pump for handling liquids carrying solid abrasive particles.

Another object is to ensure stable pressure and power characteristics of the centrifugal pump through its service life.

These and other objects and attending advantages of the invention are attained by that in a centrifugal pump for handling liquids carrying solid abrasive particles a casing of which has flow-through portion formed by a discharge passage confined by two side walls of the casing, front and rear relative to the incoming flow of the liquid being pumped, and by a peripheral wall of the casing integral with the front and rear walls, and by a flow-through passage of an impeller accommodated inside said casing of the impeller, the impeller being formed by a carrying disk mounted on a drive shaft having vanes secured thereon and by a drive disk secured on said vanes, according to the invention, the geometry of the peripheral wall of the casing follows the law of distribution of solid abrasive particles in the flow-through portion of the pump.

Preferably, the peripheral wall in the meridional section of the casing of the pump is inclined to the rear wall to form an acute angle with the axis of the impeller.

This geometry of the peripheral wall of the casing of the pump ensures an increase in the nominal surface area of contact of this wall with the surface of solid abrasive particles. In turn, concentration of solid abrasive particles per unit surface area of the peripheral wall is reduced, and the particles are uniformly distributed across the surface of this wall. In addition, such a geometry of the peripheral wall of the pump casing results in a thicker casing wall at locations where it is most susceptible to abrasive wear.

The arrangement of the peripheral wall of the casing with an inclination to its rear wall at an acute angle to the axis of the impeller is dictated by the character of travel of solid abrasive particles in the discharge passage and their contact engagement with the peripheral wall depending on the pattern of distribution of solid abrasive particles carried by the liquid being pumped in the flow-through passage of the impeller. This pattern of distribution of solid abrasive particles is generally a consequence of that the solid abrasive particles entering the flow-through passage of the impeller move along paths different from the path of flow of the liquid being pumped due to the action of the field of centrifugal forces on the solid particles and on the flow of liquid posessing of different forces of inertia as they enter the flow-through passage of the impeller. Depending on their size, the solid particles assume different positions in the space of the flow-through passage of the impeller. The boundary of area occupied by large-size particles is closer to the surface of the carrying disk, whereas the boundary of area occupied by small-size particles is remote from the surface of the carrying disk.

In view of the aforedescribed, it is possible to design pumps in which the geometry of the peripheral wall would suit in the best possible manner conditions of operations, such as the density of solid abrasive particles contained in the liquid being transferred, density of the liquid, etc.

Preferably, the angle of inclination of the peripheral wall is determined by the following relationship:

$$\alpha = \frac{\pi}{2} - \text{arc } tg \frac{\theta(\theta + \delta + a)}{f_o \cdot S_o},$$

where $\theta$ is the width of the layer of solid abrasive particle in the flow-through passage of the impeller in its meridional section;

$\alpha$ is the thickness of the carrying disk, 0.02–0.085 (m);

$\delta$ is the magnitude of clearance between the carrying disk and rear wall of the casing, 0.001–0.005 (m);

$f_o$ is the sectional area of the discharge passage, 0.00345–0.1828 ($m^2$);

$S_o$ is the volume concentration of solid abrasive particles in the liquid being pumped; to 0.35;

$f_oS_o$ is part of the sectional area of the discharge passage occupied by solid abrasive particles, $$\theta = \beta\left[1 - 0{,}6\, u \cdot v^{-1}\sqrt{dD^{-1}(\rho_s - \rho_e)\cdot \rho_e^{-1}}\right],$$

$\beta$ is the width of the flow-through passage of the impeller in its meridional section, 0.04–0.3 (m);

$\mu$ is the peripheral velocity of the impeller at the inlet, 7.5–14.7 (m/s);

$v$ is the average flow velocity of the liquid carrying solid abrasive particles, 3.8–6.9 (m/s);

d is the average diameter of abrasive particles, to 0.02 (m);

D is the diameter of the impeller at the inlet, 0.1–0.77 (m);

$\rho_s$ is the density of abrasive particles, to 4500 ($kg/m^3$);

$\rho_l$ is the density of the liquid being transferred, 1000 ($kg/m^3$).

Analysis of this relationship shows that the angle $\alpha$ of inclination of the peripheral wall of the casing to the longitudinal axis of the impeller increases during pumping liquids carrying large-size abrasive particles, as well as during pumping liquids with a higher concentration of solid abrasive particles contained therein and during the presence of abrasive particles of a higher density in the liquid.

Advisably, the casing of the pump is provided with main pump-out vanes arranged at the surface of the carrying disk of the impeller facing the rear wall of the casing so that in a section taken perpendicularly to the axis of the pump one of two adjacent pump-out vanes has a portion disposed in the central part of the carrying disk and overlapping the area of a suction vane edge of the impeller, whereas the other pump-out vane has a portion disposed at the periphery of the carrying disk and overlapping the area of a discharge vane edge of the same vane of the impeller, an outlet angle of each pump-out vane being within a range from 60° to 90°.

Here and thereafter the outlet angle of the pump-out vane is understood to mean the angle between its median line and a line directed against the vector of peripheral velocity of the impeller tangent to the outer surface of the carrying disk at the point of intersection thereof with the median line of the pump-out vane.

Such a construction of the carrying disk of the impeller prevents penetration of solid abrasive particles to the sealing assembly of the drive shaft, because solid abrasive particles that penetrate into the clearance between the end faces of the pump-out vanes and rear wall of the casing meet with the pump-out vanes are thrown to the high pressure area of the casing under the action of the field of centrifugal forces. Further, since one of the two adjacent main pump-out vanes has a portion overlapping the area of the suction vane edge of the impeller, and the other pump-out vane has a portion overlapping the area of the discharge vane edge of the same impeller vane, the thickness of the carrying disk at locations most susceptible to abrasive wear is increased. The range of variations in the outlet angles of the main pump-out vane is dictated by the need to overlap greater surface area of the carrying disk of the impeller in the area of the suction vane and discharge vane edges of the impeller to thereby prevent local damage in the form of through holes in the carrying disk of the surface area of the flow-through passage of the impeller susceptible to wear by solid abrasive particles.

The aforedescribed ensures that the life of the impeller can be more than doubled.

Favourably, the carrying disk of the impeller is provided with additional pump-out vanes interposed between the main pump-out vanes so that at least one of the additional pump-out vanes would be arranged between said two adjacent main pump-out vanes and have an outlet angle equal to the outlet angle of the main pump-out vane, because practice of operation of such pumps has shown that with a large number of pump-out vanes and large outlet angles of such pump-out vanes the wear of the pump-out vanes and of the rear wall of the casing is minimal, whereas the sufficiently large clearance between the end faces of the pump-out vanes and rear wall of the casing fails to affect the pressure developed by the pump-out vanes. Maintaining invariable the pressure produced by the pump-out vanes during operation of the pump prevents overflow of the liquid containing solid abrasive inclusions from the discharge passage to the sealing assembly of the drive shaft, whereby damage of this sealing assembly is impossible to again result in a longer service life of the pump.

Desirably, the casing of the pump is provided with pump-out vanes arranged at the surface of the driven disk facing the front wall of the casing with an outlet angle of each pump-out vanes equalling the outlet angle of the main pump-out vane, the number of such pump-out vanes being equal to the sum of the main and additional pump-out vanes at the carrying disk.

With such an arrangement of the driven disk having a plurality of pump-out vanes each having an outlet angle of between 60° and 90° wear of the pump-out vanes and front wall of the discharge passage is minimized, and the magnitude of pressure developed by the pump-out vanes is maintained even at a sufficiently large clearance between the ends of the pump-out vanes and the front wall of the casing, which minimizes volumetric leaks of the liquid in the pump during its operation.

The aforedescribed makes it possible to maintain volumetric leaks or losses of liquid at the lowest level throughout the operation cycle of the pump, and as a consequence to ensure stable pressure characteristic of the pump.

The impeller and casing of the pump are fabricated from a material of increased hardness, and therefore the end faces of the pump-out vanes and walls of the casing are not machined mechanically. It is possible to assemble the flow-through portion of the pump with sufficiently large clearances between the end faces of the pump-out vanes and walls of the casing thanks to preventing the influence of these clearances on the pressure characteristic of the pump-out vanes due to the employment of a large number of such pump-out vanes, pump-out vanes with large outlet angles at the carrying and driven disks of the impeller.

A centrifugal pump embodying the features of the present invention was used for handling a liquid carrying beneficiation products of kimberlite ore with a mixture density of 1200 kg/m$^3$, volume concentration of solids $S_o$=0.125, and the size of solid particles to 50 mm (d=15.9 mm), and exhibited a service life of the casing of 750 hours.

The centrifugal pump according to the invention was used in a beneficiation mill for producing copper concentrate, particularly for handling ore materials of the first stage of comminution with a density of the mixture of 1500 kg/m$^3$, volume concentration of solids $S_o$=0.2, and size of solid particles to 1 mm (d=0.385); the service life of the casing of this pump was 926 hours.

A centrifugal pump of the LPN 200/480 type fabricated by the "Serlachius" company and operating in similar conditions had a service life of 402 hours.

The objects and advantages of the present invention will become more fully apparent from a detailed description of its embodiments that follows taken with reference to the accompanying drawings, in which:

DETAILED DESCRIPTION OF THE INVENTION

Figure 1:
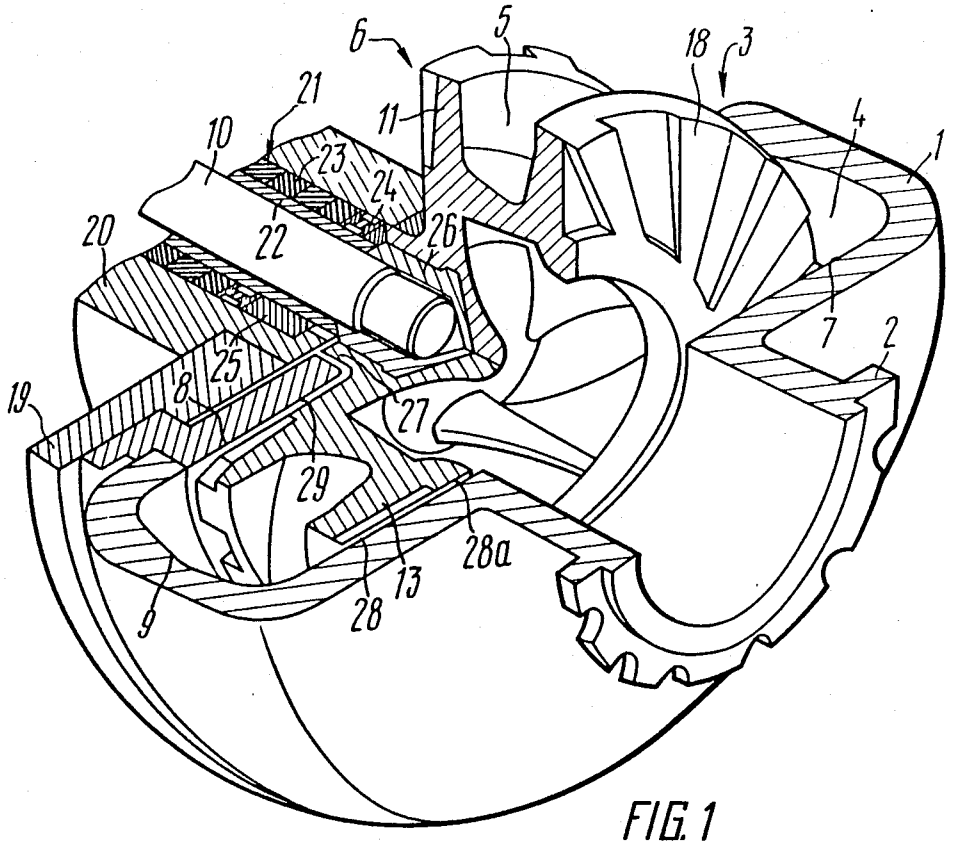
FIG. 1 is a schematic representation of a centrifugal pump according to the invention, an isometric view with a section of the casing taken in a horizontal plane and a section of the impeller taken in the vertical and horizontal planes.
Figure 2:
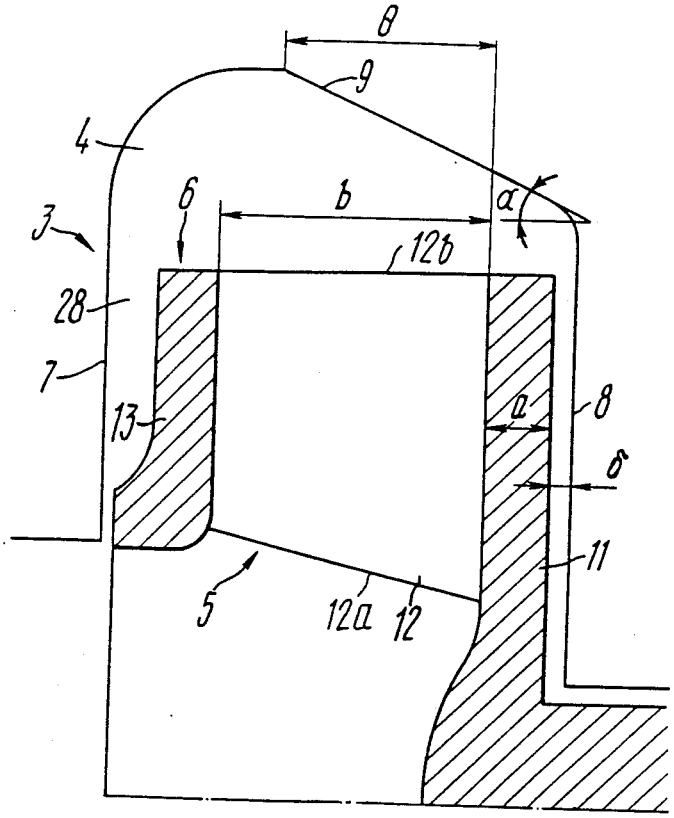
FIG. 2 shows a contour of the flow-through portion of the centrifugal pump according to the invention, an expanded view.

A centrifugal pump according to the invention for use in a beneficiation mill producing copper concentrate and intended for handling ore materials from the first stage of comminution has casing 1 (FIG. 1) with an inlet pipe 2. A flow-through part 3 (FIG. 2) of the pump is defined by a semi-spiral discharge passage 4 and a flow-through passage 5 of an impeller 6 dispposed inside the casing 1. The discharge passage 4 is confined by two side walls 7 and 8 of the casing 1, that is by the front and rear walls relative to the incoming flow, and by a peripheral wall 9 of the casing 1 integrated with the front and rear walls 7 and 8. The impeller 6 is mounted in a cantilever fashion on a drive shaft 10 (FIG. 1) and is formed by a carrying disk 11 having vanes 12 secured thereon, and a driven disk 13 secured on these vanes. The geometry of the peripheral wall 9 of the casing 1 is designed to follow the law of distribution of solid abrasive particles in the flow-through portion 3 (FIG. 2) of the pump. The peripheral wall 9 has in the meridional section of the casing 1 an inclination toward the rear wall 8 of the casing to form an acute angle $\alpha$ with the axis of the impeller 6. The angle $\alpha$ is determined by the following relationship:

$$\alpha = \frac{\pi}{2} - \text{arc } tg \frac{\theta(\theta + \delta + a)}{f_o \cdot S_o},$$

where $\theta$ is the width of the layer of solid abrasive particles in the flow-through passage 5 of the impeller 6 in the meridional section;

$\alpha$ is the thickness of the carrying disk 11 with pump-out vanes, 0.034 (m);

$\delta$ is the clearance between the carrying disk 11 and the rear wall 8 of the casing 1, 0.0025 (m);

$f_o$ is the sectional area of the discharge passage 4, 0.008 (m$^2$);

$S_o$ is the volume concentration of the solid abrasive particles in the liquid being pumped, 0.2;

$f_o.S_o$ is part of the sectional area of the discharge passage 4 occupied by solid abrasive particles.

$$\theta = \beta \left[ 1 - 0{,}6\, u \cdot v^{-1} \sqrt{d \cdot D^{-1}(\rho_s - \rho_e) \cdot \rho_e^{-1}} \right],$$

where $\mu$ is the peripheral velocity of the impeller 6 at the inlet, 10.1 (m/s);

$\beta$ is the width of the flow-through passage 5 of the impeller 6 in its meridional section, 0.065 (m);

$\upsilon$ is the average flow velocity of the liquid being pumped carrying solid abrasive particles, 5.0 (m/s);

d is the average size of abrasive particles, 0.000385 (m);

D is the diameter of the impeller 6 at the inlet 0.20 (m);

$\rho_S$ is the density of the abrasive particles, 4000 (kg/m$^3$);

$\rho_l$ is the density of the liquid, 1000 (kg/m$^3$);

By substituting the figures, it can be found that $\theta=0.058$ and $\alpha=16°$.

Figure 3:
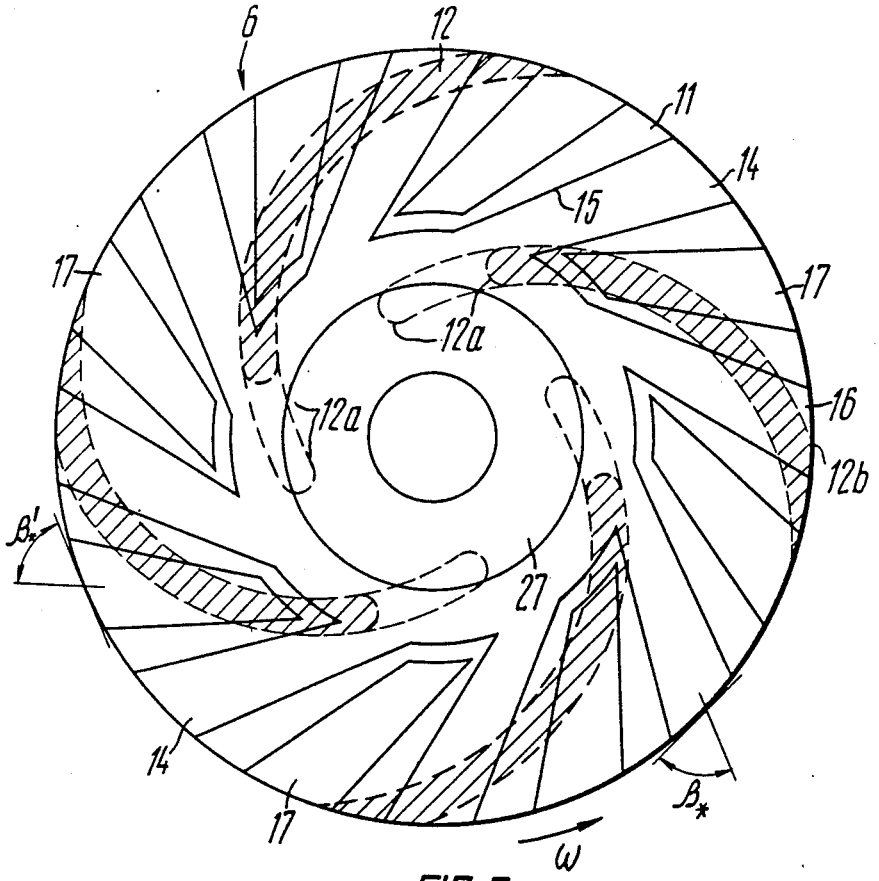
FIG. 3 is a view of a carrying disk of the impeller of the centrifugal pump according to the invention, a modified form of the main pump-out vanes with expansion toward the periphery of the carrying disk.

With reference to FIG. 3, the surface of the carrying disk 11 of the impeller 6 facing the rear wall 8 of the casing 1 accommodates main pump-out vanes 14 so that in a section made perpendicularly to the axis of the pump one of two adjacent pump-out vanes 14 has a portion 15 resting in the central part of the carrying disk 11 and overlapping the area of a suction vane edge 12*a* of the vane 12 of the impeller 6, whereas another pump-out vane 14 has a portion 16 at the periphery of the carrying disk 11 and overlapping the area of a discharge vane edge 12*b* of the same vane 12 of the impeller 6. The outlet angle $\beta*$ of each pump-out vane 14 is 67°. The pump-out vane 14 expands to the periphery of the carrying disk 11.

Figure 4:
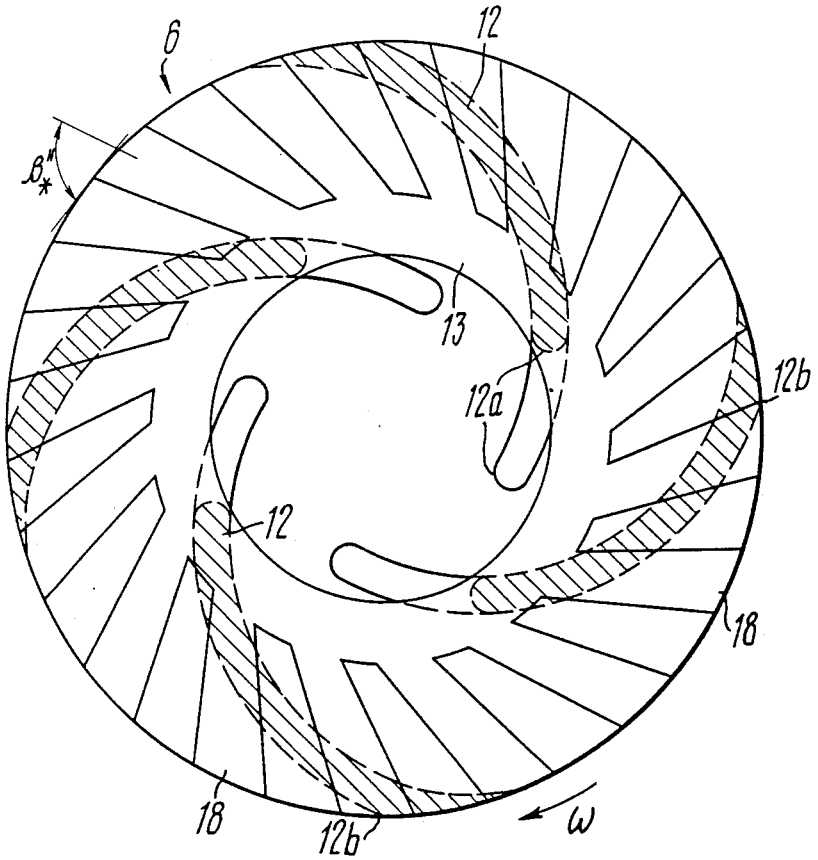
FIG. 4 is an enlarged view of a driven disk of the impeller of the centrifugal pump according to the invention.

Such a shape of the pump-out vanes is preferable for use during pumping a liquid carrying fine solid abrasive particles, when the periphery of the carrying disk 11 and driven disk 13 are most susceptible to damage. Pump-out vanes 14 of this shape are capable to protect most of the surface of the disks 11, 13 of the impeller 6. The carrying disk 11 accommodates additional pump-out vanes 17 interposed between the main pump-out vanes 14. One additional pump-out vane 17 is interposed between each two adjacent main pump-out vanes 14, this pump-out vane 17 having an outlet angle $\beta'*$ equal to the outlet angle $\beta*$ of the main pump-out vane 14. The driven disk 13 also has pump-out vanes 18 (FIG. 4). These pump-out vanes are arranged on the surface of the driven disk 13 facing the front wall 7 of the casing 1. The outlet angle $\beta''*$ of each pump-out vane 18 is equal to the outlet angle $\beta*$ (FIG. 3) of the main pump-out vane 14, the number of such pump-out vanes 18 being equal to the sum of the main and additional pump-out vanes 14 and 17 on the carrying disk 11.

The casing 1 (FIG. 1) of the pump is secured on a bracket 19, which is part of a support post 20 mountable on a frame (not shown). The support post 20 accommodates a sealing arrangement 21 of the drive shaft 10 including a protection sleeve 22 having a packing 23, a distribution ring 24, and an intermediate ring 25. The drive shaft 10 is threadedly connected to a sleeve 26 fabricated from a low-hardness steel and rigidly affixed to a hub 27 of the impeller 6. Water is admitted under pressure through the distribution ring 24 to prevent penetration of solid abrasive particles to the area of the packing 23 and also serve as for cooling the packing 23.

The centrifugal pump according to the invention operates in the following manner. Rotation of the shaft 10 (FIG. 1) of the impeller 6 produces a zone of underpressure or vacuum at the inlet, and the liquid carrying solid particles is therefore admitted through the inlet pipe 2 to the flow-through passage 5 of the impeller 6. Solid particles entering the flow-through passage 5 move along travel paths different from the path of flow of the liquid being pumped due to the action of centrifugal forces on the solid particles and on the flow of liquid possessing different forces of inertia. Depending on the size, the particles tend to occupy various sections within the volume of the flow-through passage 5 (FIG. 2) of the impeller 6. The border of the area occupied by particles of larger size is closer to the surface of the carrying disk 11 (FIG. 1), whereas the border of the area occupied by particles of smaller size is remote from the surface of the carrying disk 11.

The liquid carrying solid abrasive particles is then conveyed from the flow-through passage 5 to the discharge passage 4 in which solids occupy part of its interior. The sectional area of the discharge passage 4 occupied by solid abrasive particles is equal to $f_o.S_o$. Thanks to the arrangement of the peripheral wall 7 (FIG. 2) of the casing 1 with an inclination to its rear wall 8 at an acute angle $\beta=16°$ to the axis of the impeller 6, the nominal area of contact of this wall 7 with the surface of solid abrasive particles increases, which results in reduced concentration of solid particles per unit surface area of the peripheral wall 9 and ensures a relatively uniform distribution of particles across the surface of this wall. This geometry of the peripheral wall 9 of the casing 1 ensures an increase in the thickness of the wall 9 in the zone where it is most prone to abrasive wear.

Under the action of pressure the liquid carrying solid abrasive particles flows from the discharge passage 4 to a discharge pipe (not shown) to be thereafter conveyed along a pipeline to a using facility.

Solid abrasive particles which enter a clearance 28 between the end faces of the pump-out vanes 18 (FIG. 4) and front wall 7 (FIG. 1) of the casing 1 collide with the pump-out vanes 18 (FIG. 4) of the driven disk 13 of the impeller 6 to be thrown by centrifugal forces to the high pressure area of the discharge passage 4. Provision of the driven disk 13 with a plurality of pump-out vanes 18, such as sixteen in number, with each such pump-out vanes having an outlet angle $\beta''*$ of, for example, 67°, minimizes wear of the pump-out vanes 18 and of the front wall 7 of the casing 1, and thereby ensures that the clearance 28*a* between the end face of the disk 13 and front wall 7 of the casing in the area of inlet of the flow of liquid being pumped to the impeller 6 remains invariable. This minimizes leaks of the liquid during pump operation. Solid abrasive particles entering the clearance 29 between the end faces of the pump-out vanes 14 and 17 (FIG. 3) and the rear wall 8 (FIG. 1) of the casing 1 of the pump and colliding with the pump-out vanes 14 and 17 (FIG. 3) are acted upon by centrifugal forces to be thrown to the high pressure zone of the discharge passage 4 (FIG. 1) thereby preventing penetration of such solid abrasive particles to the sealing arrangement 21 of the drive shaft 10. During the travel of solid abrasive particles in the flow-through passage 5 of the impeller 6, depending on the size of such particles, wear of the carrying disk 11 (FIG. 3) takes place either in its central part adjacent the suction vane edge 12*a* of the vane 12 of the impeller 6, or at the periphery thereof in the area of the discharge vane edge 12*b* of the impeller vane. Solid abrasive particles cause local damage to the carrying disk 11 and then meet an obstacle in the form of the body of the main pump-out vanes 14. When the number of main pump-out vanes 18 is 8 and the outlet angle $\beta*$ is 67°, the pum-out vanes are capable to overlap most of the surface of the carrying disk 11 in the area of the suction vane and discharge vane edges 12a and 12b of the impeller 6 to result in prevention from intensive abrasive wear of most of the surface area of the flow-through passage 5 (FIG. 1) of the impeller. Thanks to that the carrying disk 11 (FIG. 3) is provided with sixteen pump-out vanes 14 and 17 having substantial outlet angles $\beta_*$ and $\beta'_*$ wear of the pump-out vanes 14, 17 per se is minimized, which ensures invariable clearance 29 between the end faces of the pump-out vanes and rear wall 8. Continuity of this clearance 29 ensures invariable magnitude of the hydrodynamic axial force acting on the supports of the proposed pump.

With such an arrangement of the flow-through part 3 (FIG. 2) of the centrifugal pump leaks of the liquid being pumped are minimized. Hydraulic losses in the discharge passage 4 vary insignificantly through the operation cycle of the pump. A consequence is a stable head-capacity characteristic of the pump.

Figure 5:
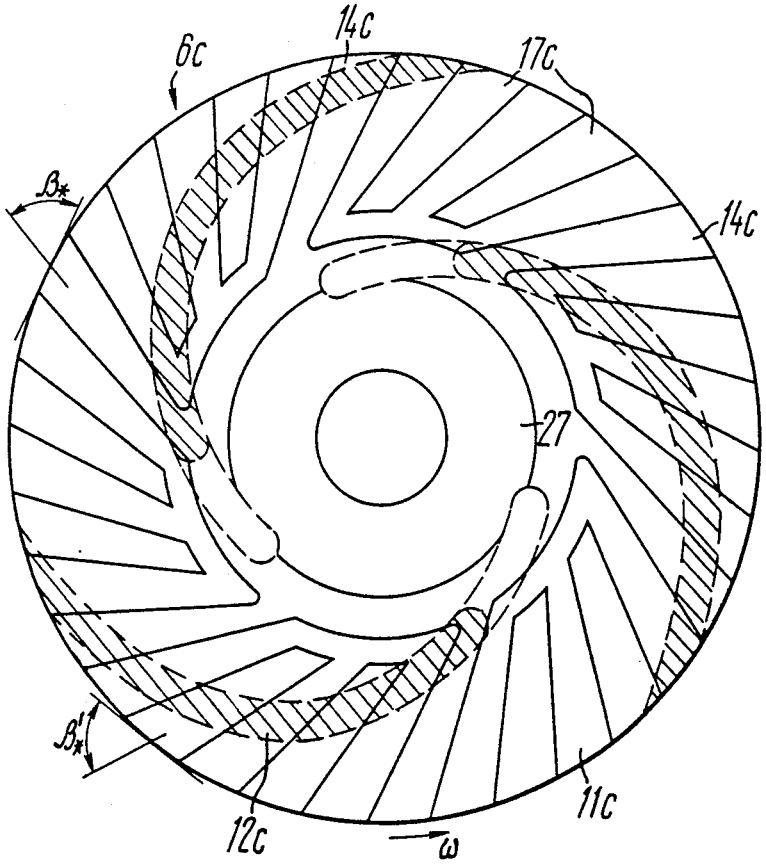
FIG. 5 is a view of the carrying disk of the impeller of the centifugal pump according to the invention, a modified form of additional pump-out vanes.

If the impeller 6c (FIG. 5) of the pump has few, such as three, vanes 12c, then for ensuring minimum wear of the pump-out vanes 14c, 17c at the carrying disk 11c and pump-out vanes (not shown) at the drive disk and for simplifying the assembly of the pump it is necessary that between each pair of the main pump-out vanes 14c at least two additional pump-out vanes 17c be provided.

Figure 6:
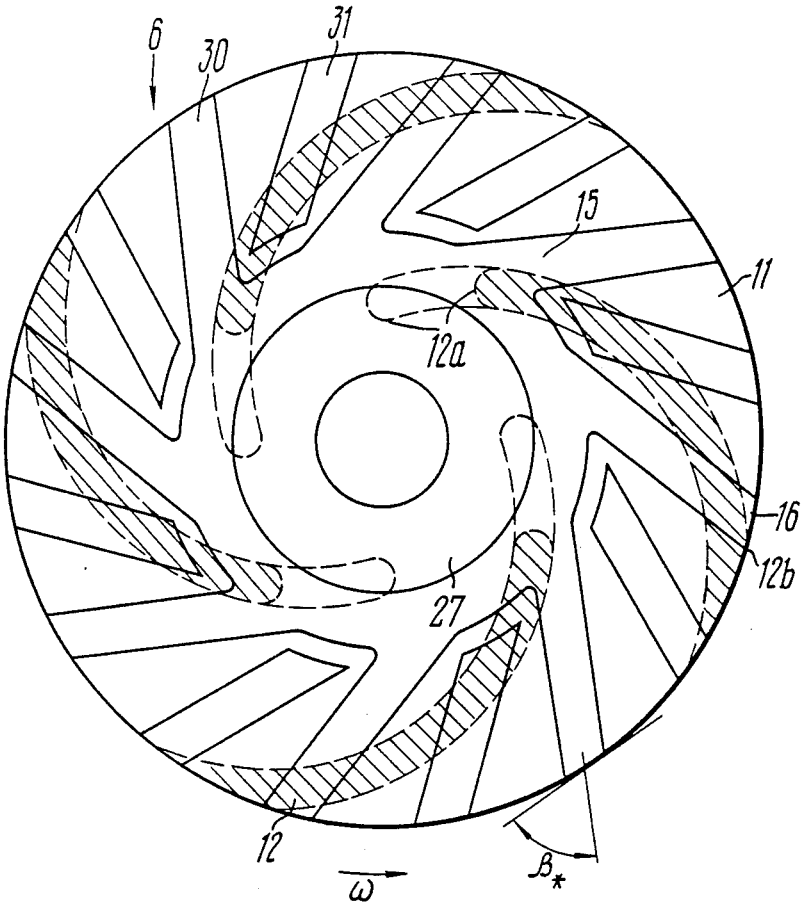
FIG. 6 is an enlarged view of the carrying disk of the impeller of the, centrifugal pump according to the invention.

For pumping liquids carrying large-size abrasive particles it is preferable that the main pump-out vanes 30 (FIG. 6) and additional pump-out vanes 31 be of rectilinear shape, since wear of the pump-out vanes at the periphery is insignificant.

A centrifugal pump intended for handling an industrial product resulting from beneficiation of iron ore with a density of mixture of 1420 kg/m$^3$, volume concentration of solids $S_o$=0.14, and prevailing size of particles d below 0.045 mm, in which the pump casing embodied the features of the present invention, the impeller embodied the features of SU, A, No. 769,095, and pump-out vanes made according to the present invention exhibited a service life of the flow-through section of 18,000–20,000 hours. A centrifugal pump for handling iron ore concentrate with a density of mixture of 2050 kg/m$^3$, volume concentration of solids $S_o$=0.3, and size of prevailing particles d of less than 0.045, having a housing embodying the features of the present invention, using an impeller according to SU, A, No. 769,095, and having pump-out vanes fabricated according to the invention, exhibited a service life of the flow-through section of 12,000–15,000 hours.

What is claimed is:

1. A centrifugal pump for handling liquids carrying solids abrasive particles, comprising:

a casing for converting the kinetic energy of the liquid being pumped into potential energy of pressure;

two side walls of said casing for forming a flow of the liquid being pumped carrying solid abrasive particles, a front and rear walls relative to the incoming flow of the liquid being pumped;

an impeller accommodated in said casing and serving for converting mechanical energy of rotation into kinetic;

a drive shaft of said impeller for imparting a torque to the impeller, disposed in said casing;

a carrying disk of said impeller for imparting a torque to the impeller and forming a flow of the liquid being pumped carrying solid abrasive particles, mounted on said drive shaft;

vanes of said impeller for converting the mechanical energy of rotation into kinetic energy of the kinetic energy of the liquid being pumped, secured on said carrying disk;

a driven disk of said impeller for forming a flow of the liquid being pumped secured on said vanes of said impeller;

a flow-through passage of said impeller for forming a flow of the liquid being pumped and converting into potential energy of pressure, confined by said carrying disk, said vanes, and said driven disk;

a peripheral wall of said casing for forming a flow of the liquid being pumped carrying solid abrasive particles, said peripheral wall being integral with said two side walls of said casing, said peripheral wall having a geometry following the pattern of distribution of solid abrasive particles so that a meridional section of said peripheral wall is inclined downwards to said rear wall and forms an acute angle with the axis of rotation of said impeller, determined by the following relationship:

$$\alpha = \frac{\pi}{2} - \text{arc tg}\,\frac{\theta(\theta + \delta + a)}{f_o S_o}$$

wherein $\theta$ is the width of the layer of solid abrasive particles in said flow-through passage of the impeller in the meridional section thereof;

a is the thickness of the carrying disk, 0.02–0.085 (m);

$\delta$ is the size of the clearance between said carrying disk and said rear wall of the casing, 0.001–0.005 (m);

$f_o$ is the sectional area of said discharge passage, 0.00345–0.1828 (m$^2$);

$S_o$ is the volume concentration of solid abrasive particles in the liquid being pumped, up to 0.35;

$\theta = b[1-0.6U\,v^{-1}\sqrt{d}D^{-1}(p_s-f_e)p_e^{-1}]$, wherein b is the width of said flow-through passage of the impeller in the meridional section thereof, 0.04–0.3 (m);

U is the peripheral velocity of said impeller at the inlet, 7.5 14.7 (m/sec);

v is the average flow velocity of the liquid being pumped carrying abrasive particles, 3.8-6.9 (m/sec);

d is the average diameter of abrasive particles, up to 0.02 (m);

D is the diameter of said impeller at the inlet, 0.1–0.77 (m);

$\rho_s$ is the density of abrasive particles, up to 4,500 (kg/m$^3$)

$\rho_e$ is the density of the liquid, 1,000 (kg/m$^3$);

a discharge passage for collecting the liquid being pumped, converting the energy and conveying the liquid being pumped carrying solid abrasive particles to the user, said discharge passage being confined by said two side walls and said peripheral walls of said casing and communicating with said flow-through passage; and a flow-through portion formed by said flow-through passage of said impeller and said discharge passage for forming a flow of the liquid being pumped carrying solid abrasive particles, converting the kinetic energy of the liquid being pumped into potential energy of pressure, and conveying the liquid being pumped to the user.

2. A centrifugal pump for handling liquid carrying solid abrasive particles as defined in claim 1, comprising:

main pump-out vanes for thickening the body of said drive disk in the zone where it is most susceptible to abrasive wear, preventing the penetration of solid abrasive particles from said discharge passage to the zone of said drive shaft, and reducing the hydroxydynamic axial force, said main pump-out vanes being arranged at the surface of said carrying disk facing the rear wall;

an outlet angle of each of said main pump-out vanes being within a range from 60° to 90°;

a suction edge of each said impeller vane for forming a flow of liquid being pumped at the inlet to said flow-through passage;

a discharge edge of each said impeller vane for forming a flow of liquid being pumped at the outlet from said flow-through passage as the liquid enters said discharge passage; and a first portion of said main pump-out vanes perpendicular to the axis of the pump so as to be disposed in a central part of said carrying disk to overlap the area of said suction edge of said impeller vane and a second portion of an adjacent main pump-out vane, perpendicular to the axis of the pump, disposed at a peripheral part of said carrying disk and overlapping the area of said discharge edge of said impeller vane.

3. A centrifugal pump for handling liquids carrying solid abrasive particles as defined in claim 2, comprising:

additional pump-out vanes for preventing the penetration of solid abrasive particles from said discharge passage to the zone of said drive shaft and reducing the hydrodynamic axial force, said additional pump-out vanes being arranged on said carrying disk between said main pump-out vanes;

at least one of said additional pump-out vanes arranged between each said two adjacent pump-out vanes;

the outlet angle of each of said additional pump-out vanes being equal to said outlet angle of each of said main pump-out vanes.

4. A centrifugal pump for handling liquids carrying solid abrasive particles as defined in claim 3, comprising:

pump-out vanes for preventing the penetration of solid abrasive particles from said discharge passage to the inlet of said impeller, said pump-out vanes being arranged at the surface of said drive disk facing the front wall, the number of said pump-out vanes being equal to the sum of said main pump-out vanes and said additional pump-out vanes;

the outlet angle of each of said pump-out vanes being equal to said outlet angle of each of said main pump-out vanes.

5. A centrifugal pump for handling liquids carrying solid abrasive particles comprising:

a casing for converting the kinetic energy of the liquid being pumped into potential energy of pressure;

two side walls of said casing for forming a flow of the liquid being pumped carrying solid abrasive particles, particularly front and rear walls relative to the incoming flow of the liquid being pumped;

an impeller accommodated in said housing and serving for converting the mechanical energy of rotation kinetic energy of the liquid being pumped carrying solid abrasive particles partially converted into potential energy of pressure;

a drive shaft of said impeller for imparting a torque to the impeller disposed in said casing;

a carrying disk of said impeller for imparting a torque to the impeller and forming a flow of the liquid being pumped carrying solid abrasive particles mounted on said drive shaft;

vanes of said impeller for converting the mechanical energy of rotation into kinetic energy of the liquid being pumped and forming a flow of the liquid being pumped secured on said carrying disk;

a driven disk of said impeller for forming a flow of the liquid being pumped secured on said vanes of said impeller;

a flow-through passage of said impeller for forming a flow of the liquid being pumped and converting the mechanical energy of rotation of said impeller into kinetic energy of the liquid being pumped partially converted into potential energy of pressure confined by said carrying disk, said vanes and said driven disk;

a peripheral wall of said casing for forming a flow of the liquid being pumped carrying solid abrasive particles, this peripheral wall being integral with said two side walls of said casing and having a geometry following the pattern of distribution of the solid abrasive particles in said flow-through portion so that a meridional section of said peripheral wall is inclilned downwards to said rear wall and forms an acute angle with the axis of rotation of said impeller;

a discharge passage for collecting the liquid being pumped, converting the energy and conveying the liquid carrying solid abrasive particles to a using facility, this discharge passage being confined by said two side walls and said peripheral wall of said casing and communicating with said flow-through passage;

a flow-through portion formed by said flow-through passage of said impeller and said discharge passage for forming a flow of the liquid being pumped carrying solid abrasive particles, converting the mechanical energy of rotation of said impeller into kinetic energy of the liquid being pumped, converting the kinetic energy of the liquid being pumped into potential energy of pressure, and conveying the liquid to a using facility;

main pump-out vanes for thickening the body of said drive disk in the zone where it is most susceptible to abrasive wear, preventing penetration of solid abrasive particles from said discharge passage to the zone of said drive shaft and reducing the hydrodynamic axial force, said main pump-out vanes being arranged at the surface of said carrying disk facing the rear wall;

an outlet angle of each of said main pump-out vanes being within a range of from 60° to 90°;

a suction edge of each said impeller vane for forming a flow of the liquid being pumped at the inlet to said flow-through passage;

a discharge edge of each of the impeller vane for forming a flow of the fluid being transferred at the outlet from said flow-throug passage as the liquid enters said discharge passage;

a first portion of said main pump-out vanes perpendicular to the axis of the pump so as to be disposed in a central part of said carrying disk to overlap the area of said suction edge of said impeller vane and a second portion of an adjacent main pump-out vane, perpendicular to the axis of the pump, disposed at a peripheral part of said carrying disk and overlapping the area of said discharge edge of said impeller vane;

additional pump-out vanes for preventing the penetration of solid abrasive particles from said discharge passage to the zone of said drive shaft and reducing the hydrodynamic axial force, said additional pump-out vanes being arranged on said carrying disk between said main pump-out vanes;

at least one of said additional pump-out vanes arranged between each said two adjacent pump-out vanes; and the outlet angle of each of said additional pump-out vanes being equal to said outlet angle of each of said main pump-out vanes.

6. A centrifugal pump for handling liquids carrying solid abrasive particles as defined in claim 5, comprising:

pump-out vanes for preventing the penetration of solid abrasive particles from said discharge passage to the inlet of said impeller, said pump-out vanes being arranged at the surface of said drive disk facing the front wall, the number of said pump-out vanes being equal to the sum of said main pump-out vanes and said additional pump-out vanes;

the outlet angle of each of said pump-out vanes being equal to said outlet angle of each of said main pump-out vanes.

* * * * *